US007717727B2

(12) United States Patent
Li

(10) Patent No.: US 7,717,727 B2
(45) Date of Patent: May 18, 2010

(54) LATCHING DEVICE FOR LOCKING A DAUGHTER BOARD IN AN EDGE CONNECTOR

(75) Inventor: Hua Li, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/380,707

(22) Filed: Mar. 2, 2009

(65) Prior Publication Data

US 2009/0221172 A1 Sep. 3, 2009

(30) Foreign Application Priority Data

Feb. 29, 2008 (CN) ..... 2008 2 0032412 U

(51) Int. Cl.
*H01R 13/62* (2006.01)

(52) U.S. Cl. ..... 439/328; 439/638

(58) Field of Classification Search ..... 439/328, 439/638

See application file for complete search history.

(56) References Cited

U.S. PATENT DOCUMENTS 4,938,701 A * 7/1990 Heberling ..... 439/65
6,971,899 B1 * 12/2005 Liu ..... 439/326
7,134,896 B1 * 11/2006 Chen ..... 439/326
7,182,618 B1 * 2/2007 Choy et al. ..... 439/328
7,241,159 B1 * 7/2007 Chen ..... 439/326
7,300,298 B2 * 11/2007 Kameda ..... 439/326
7,470,136 B2 * 12/2008 Yahiro et al. ..... 439/326
7,497,739 B2 * 3/2009 Zhang et al. ..... 439/638

FOREIGN PATENT DOCUMENTS

CN 2874855 Y 2/2007

* cited by examiner

*Primary Examiner*—Truc T Nguyen
(74) *Attorney, Agent, or Firm*—Andrew C. Cheng; Wei Te Chung; Ming Chieh Chang

(57) ABSTRACT

A latching device includes a base member of insulating material including a bridge portion and a pair of board-connecting portions connected by the bridge portion; a metallic latching member located at a front face of the bridge portion of the base member and including a latching portion toward a top face of the board-connecting portion; a metallic grounding member including a bridge portion and a pair of connecting portions extending downwards from two opposite ends of the bridge portion; each connecting portion including a first retaining portion and a second retaining portion and retained in corresponding slots defined on a rear face of the board-connecting portion. The grounding member is secured to a rear of the base member, the first retaining portion is located higher than the second retaining portion.

10 Claims, 4 Drawing Sheets

LATCHING DEVICE FOR LOCKING A DAUGHTER BOARD IN AN EDGE CONNECTOR

BACKGROUND OF THE INVENTION

1. Field of the Invention

The present invention relates to a latching device, which is used for retaining a daughter board such as a memory card in an electrical connector to complete an electrical connection between the daughter board and a mother board.

2. Description of Related Art

A conventional latching device for retaining a daughter board in a card edge connector, includes an insulating base member, a latching member attached on a front face of the base member and a grounding member attached on a rear face of base member, both of which is retained on the base member through bolts. The grounding member includes a slender bridge portion and a pair of retaining portions extending from two opposite ends of the bridge portion and a pair of solder portions. The retaining portions are inserted into and retained in corresponding slots defined in the rear face of the base member. The grounding member might be abutting against the rear face loosely, especially in a high type base member.

SUMMARY OF THE INVENTION

An object of the present invention is to provide a latching device with a slender grounding member fitly attached on a rear face thereof.

In order to achieve above-mentioned object, a latching device comprises a base member of insulating material including a bridge portion and a pair of board-connecting portions connected by the bridge portion; a metallic latching member located at a front face of the bridge portion of the base member, the latching member comprising a latching portion toward a top face of the board-connecting portion; a metallic grounding member comprising a bridge portion and a pair of connecting portions extending downwards from two opposite ends of the bridge portion, the grounding member being secured to a rear of the base member; each connecting portion comprising a first retaining portion and a second retaining portion and retained in corresponding slots defined on a rear face of the board-connecting portion, the first retaining portion being located higher than the second retaining portion.

Other objects, advantages and novel features of the present invention will become more apparent from the following detailed description of the present embodiment when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
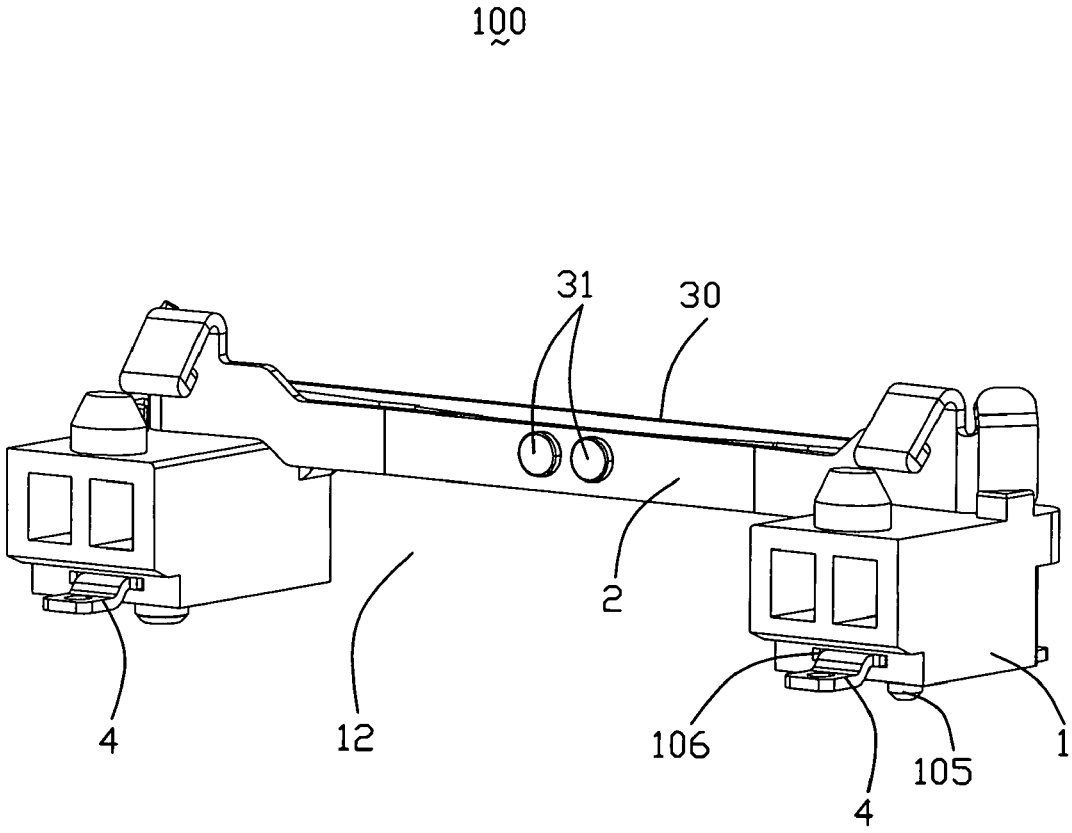
FIG. 1 is a front perspective view of a latching device in accordance with the present invention.

Reference will be made to the drawing figures to describe the present invention in detail, wherein depicted elements are not necessarily shown to scale and wherein like or similar elements are designated by same or similar reference numeral through the eight views and same or similar terminology.

A latching device 100 shown in FIGS. 1 through 4 are used to be assembled on a mother board to lock one end of a daughter board (not shown), of which another end is inserted in an electrical connector (not shown) spaced seating on the mother board from the latching device 100. Therefore, an electrical connection between the daughter board and a mother board are established. The latching device includes an insulating base member 1 of resin material, a latching member 2 and a grounding member 3.

The base member 1 includes a pair of board-connecting portions 10 spaced from each other and integrally connecting by a bridge portion 11. The bridge portion 11 is located at a back-top edge of the board-connecting portions 10. Each board-connecting portion 10 defines a positioning post 101 and a limited portion 102 of triangle shape at a top face 109 thereof, wherein the post 101 is near to a front edge of the board-connecting portion 10 compared with the limited portion 102. Each board-connecting portion 10 define a retaining post 105 shown in FIG. 1, the retaining posts 105 are used to be inserted in corresponding holes on the mother board to retain the device 100 on the mother board. Moreover, a board lock 4 is provided with a portion 40 retained in a slot 106 on a front face 107 of the board-connecting portion 10 and a soldering portion 41 extending out of the board-connecting portion to be soldered on the mother board, thereby the device 100 is assembled on the PCB.

The latching member 2 made of a longitudinal metal sheet is resilient and includes a bridge portion 20 which has two hole 21 at the middle portion thereof and opposite arm portions 22 extending therefrom. The holes 21 of the latching member 2 corresponds to holes 112 running through the bridge portion 11 and a pair of bolts 31 and other like article secure the bridge portion 20 on a front face 110 of the bridge portion 11. The bridge portion 11 of the base member defines the arc front face 110, thereby arm portions 22 can shift rearwards until against the front face 110 of the bridge portion 11. The top face 114 of the bridge is used for picking-up.

A pair of latching portions 23 bend from a top edge of the opposite ends of the bridge portion 22 respectively. The latching portions slant forwards and downward to face the top faces 109/supporting faces of the board-connecting portions, thereby a card-end receiving space is defined, and a top face 231 of the latching portion is adapted for guiding the daughter board. A pair of handle portions 24 bends outwards and rearward for a user's operation.

The grounding member 30 is made of a conductive metal sheet. The grounding member includes a longitudinal bridge portion 301 with two holes 306 at a middle portion thereof. The bolts 31 pass into the holes 306, 112 and 21 and retain the bridge portion 301 of the grounding member 30 on the rear face of the bridge portion 11 of the base member 11. The grounding member 30 defines a connecting portion 302 extending downwards from a bottom edge of the opposite ends of the bridge portion 301, the connecting portions 302 abut against the back face of the base member. A first retaining portion or tab 303 bends forwards from a lateral edge of the connecting portion 302, which is inserted into and retained in a slot 103 (labeled in FIG. 4) on a back face 108 of the board-connecting portion 10. A second retaining portion 304 bends forward from a bottom edge of the connecting portion 302 with barbs 3041 at an inner edge thereof, which is inserted into and retained in a slot 104 (labeled in FIG. 4) on the back face of the board-connecting portion 10. The second retaining portions are wider than the connecting portion 302 in the longitudinal direction of the latching device, as a result a soldering portion 305 extends backward from a back edge of the second retaining portion. The soldering portions 305 extend out of the board-connecting portion 10. The grounding trip completes through the grounding member 30 and the bolts 31, which two form a grounding device 3.

Figure 2:
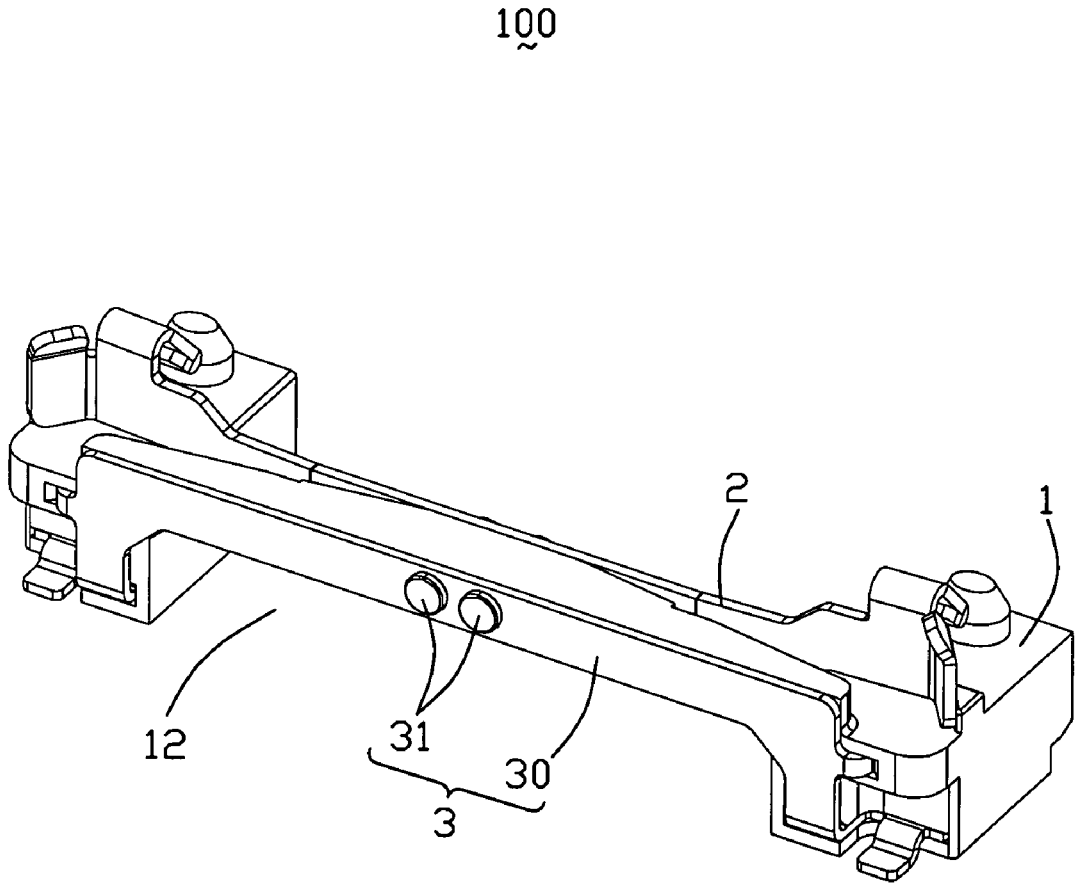
FIG. 2 is a rear perspective view of the latching device.
Figure 3:
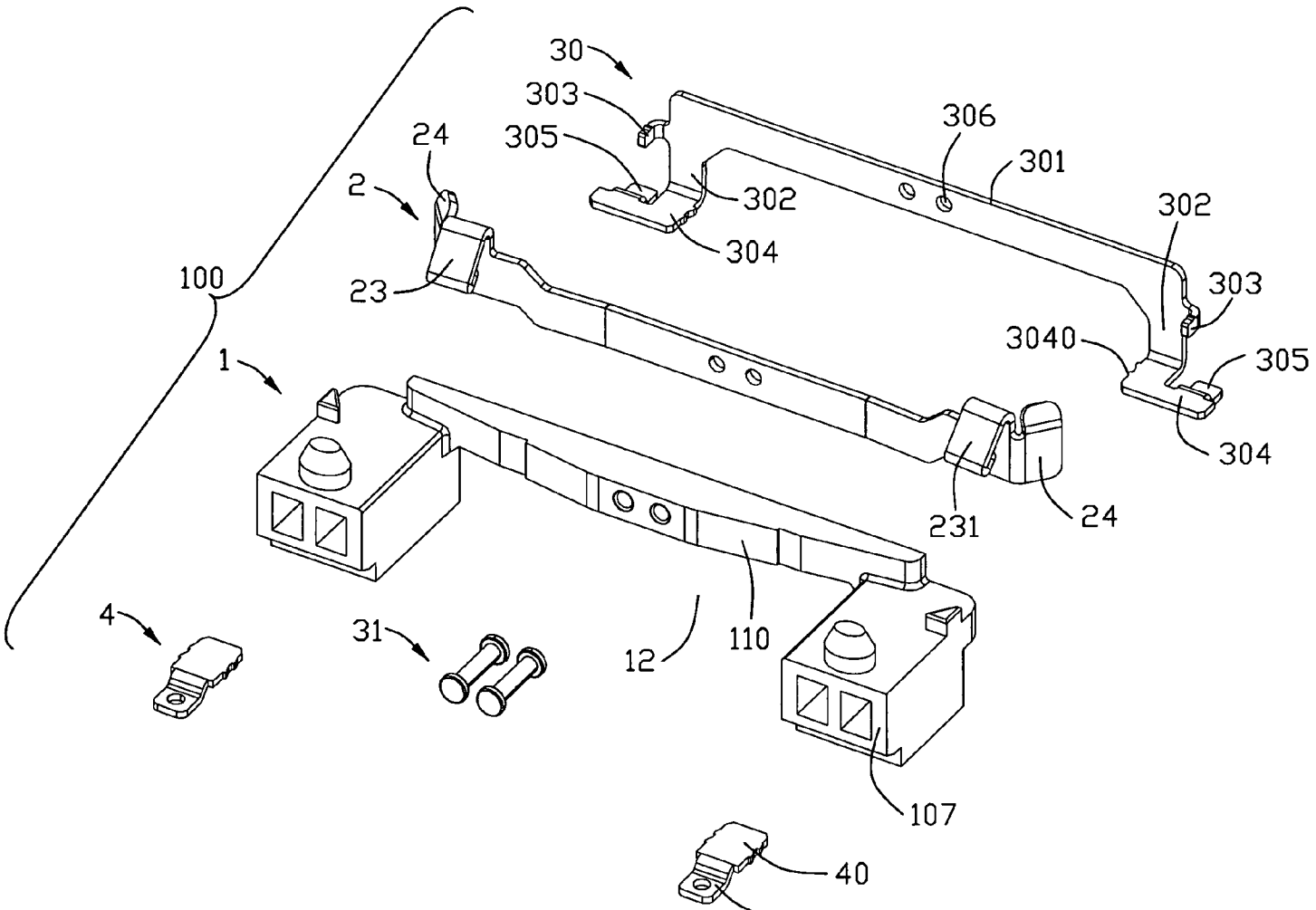
FIG. 3 is an exploded view of the latching device shown in FIG. 1.
Figure 4:
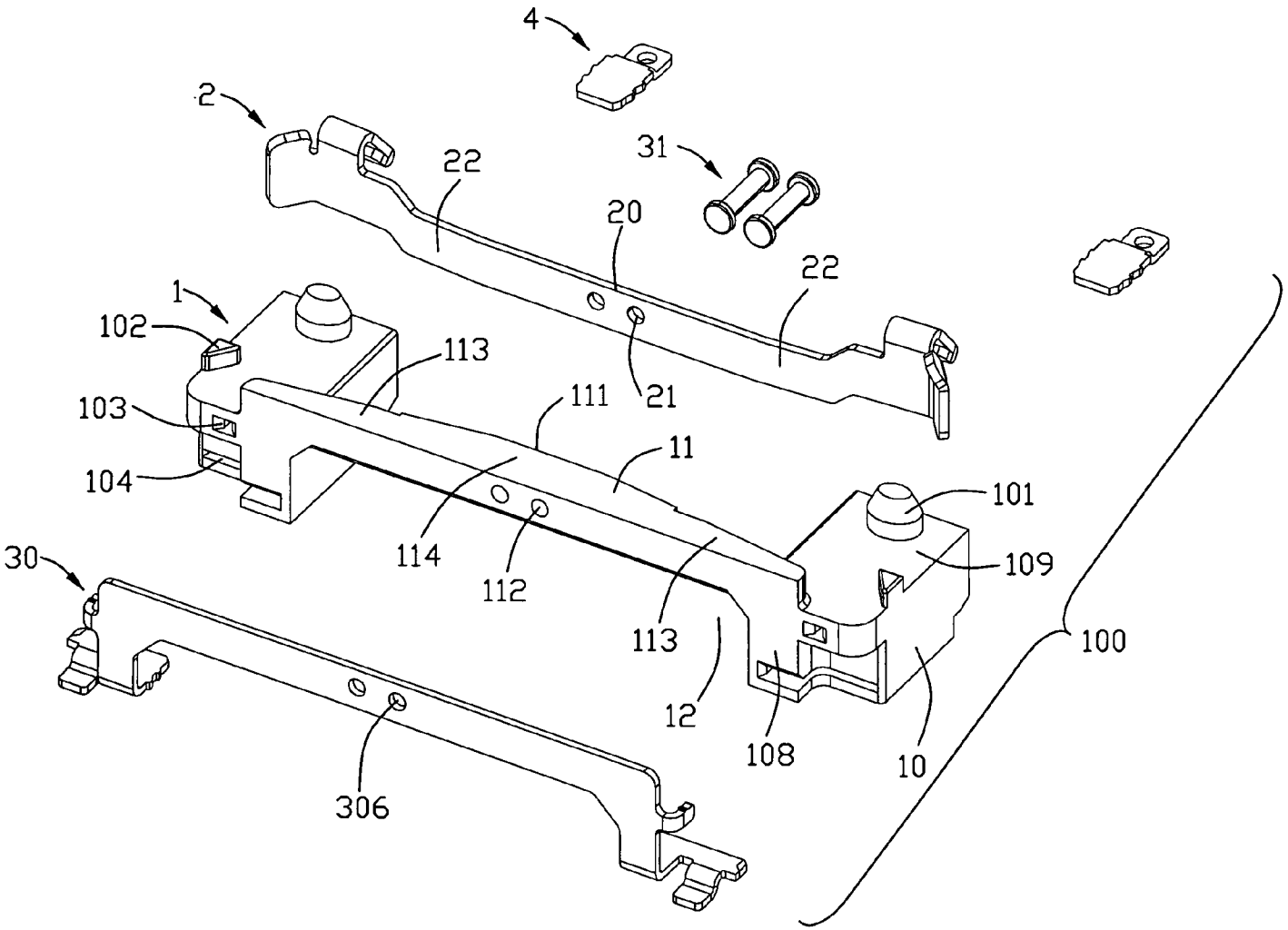
FIG. 4 is an exploded view of the latching device shown in FIG. 2.

As shown in FIG. 2, the first retaining portion 303 and the second retaining portion 304 are located in different positions along a high direction, thereby the connecting portion 302 are tight abutting against the board-connecting portion 10. The barbs 304 of the second retaining portion also offset from the first retaining portions 303 to further secure the connecting portions against the board-connecting portion 10.

However, the disclosure is illustrative only, changes may be made in detail, especially in matter of shape, size, and arrangement of parts within the principles of the invention.

What is claimed is:

1. A latching device comprising:

a base member of insulating material including a bridge portion and a pair of board-connecting portions connected by the bridge portion;

a metallic latching member located at a front face of the bridge portion of the base member, the latching member comprising a latching portion toward a top face of the board-connecting portion;

a metallic grounding member comprising a bridge portion and a pair of connecting portions extending downwards from two opposite ends of the bridge portion, the grounding member being secured to a rear of the base member;

each connecting portion comprising a first retaining portion and a second retaining portion and retained in corresponding slots defined on a rear face of the board-connecting portion, the first retaining portion being located higher than the second retaining portion;

wherein the second retaining portion is parallel to the top face of the board-connecting portion, and includes barbs at inner edges thereof;

wherein the barbs offset from the first retaining portion in a longitudinal direction of the latching device.

2. The latching device as described in claim 1, wherein the first retaining portion is perpendicular to the top face of the board-connecting portion.

3. The latching device as described in claim 1, wherein a soldering portion extends from a rear edge of the second retaining portion and extends out of the board-connecting portion.

4. The latching device as described in claim 3, further comprising a pair of metallic bolts attaching the latching member and the grounding member to the board-connecting of the base member.

5. A latching device adapted for locking/unlocking a daughter board in an edge card connector assembled on a printed circuit board (PCB) to complete an electrical connection between the daughter board and the mother board, comprising:

a base member having a pair of board-connecting portions for assembling on the PCB;

each board-connecting portion having a supporting face for supporting one end of the daughter board;

a latching member having a pair of latching portions facing the supporting face to sandwich said one end of the daughter board;

a grounding member attached on the board-connecting portions and comprising a first retaining portion and a second retaining portion retained in corresponding slots defined on the board-connecting portions;

wherein the first retaining portion and the second retaining portion are arranged at different heights;

wherein the first retaining portion and the second retaining portion offset in a longitudinal direction of the latching device.

6. A latching device assembly for retainably connecting a daughter board to an electrical connector under condition that the connector is mounted upon a mother board and the daughter board is parallel to said mother board in use, comprising:

an insulative base member including a bridge portion and a pair of board-connecting portions located at two opposite ends of the bridge portion, said bridge portion defining opposite front and rear faces wherein the front face is directed toward said electrical connector;

a metallic latching member attached upon the front face of the bridge portion and provided with a pair of latching portions at thereof two opposite ends corresponding to said pair of board-connecting portions for holding said daughter board;

a metallic grounding member attached upon the rear face of the bridge portion and provided with a pair of soldering portions at thereof two opposite ends for soldering to the mother board;

wherein said grounding member defines a pair of retaining section at said two opposite ends to secure to the corresponding board-connecting portions, respectively, and the corresponding soldering portions extending from the corresponding retaining sections, respectively;

wherein said grounding member further includes another pair of retaining sections at the two opposite ends for securement to the corresponding board-connecting portions, respectively;

wherein said pair of retaining sections are higher than said pair of retaining sections with regard to the mother board;

wherein one of the pair retaining portions includes barbs at inner edges thereof wherein the barbs offset from the other one of the pair retaining portions in a longitudinal direction of the latching device.

7. The latching device assembly as claimed in claim 6, further including a pair of board locks secured to the corresponding board-connecting portions, respectively, and opposite to the corresponding soldering portions in a front-to-back direction, respectively.

8. The latching device assembly as claimed in claim 6, wherein via said pair of board-connecting portions, said bridge portion is spaced upwardly from the mother board with a distance larger than a dimension of said bridge portion in a vertical direction.

9. The latching device assembly as claimed in claim 6, wherein said latching member is grounded to the grounding member via a metal piece extending from the front face to the rear face.

10. The latching device assembly as claimed in claim 9, wherein said metal piece secure both the latching member and the grounding member to said bridge portion.

* * * * *